US005788346A

United States Patent [19]

Jacobson et al.

[11] Patent Number: 5,788,346

[45] Date of Patent: Aug. 4, 1998

[54] STAND FORMING MEMBERS

[75] Inventors: Jason R. Jacobson, St. Paul, Minn.; Andrew C. Lamberson, Hudson, Wis.; James A. Wilson, North St. Paul, Minn.

[73] Assignee: Minnesota Mining and Manufacturing Company, St. Paul, Minn.

[21] Appl. No.: 734,281

[22] Filed: Oct. 21, 1996

[51] Int. Cl.[6] ..... A47B 87/02

[52] U.S. Cl. ..... 312/108; 248/346.01; 248/917; 248/924; 312/348.2; 312/348.6; 312/223.2; 312/334.44

[58] Field of Search ..... 312/107, 108, 312/109, 348.1, 348.2, 348.6, 223.2, 334.44; 248/346.01, 917, 924

[56] References Cited

U.S. PATENT DOCUMENTS

| | | | |
|---|---|---|---|
| 2,227,892 | 1/1941 | Soldan | 312/107 |
| 2,926,978 | 3/1960 | Mitchell | 312/334.44 X |
| 3,133,771 | 5/1964 | Dorman | 312/107 |
| 3,606,506 | 9/1971 | Ungaro | 312/107 X |
| 3,642,337 | 2/1972 | Manheim | 312/107 X |
| 3,805,935 | 4/1974 | Armstrong | 192/113 A |
| 4,192,562 | 3/1980 | Bishoff et al. | 312/108 |
| 4,206,955 | 6/1980 | Cooper | 312/108 X |
| 4,592,601 | 6/1986 | Hlinksy et al. | 312/108 X |
| 5,062,609 | 11/1991 | Hames et al. | 248/676 |
| 5,466,057 | 11/1995 | Blankenburg | 312/108 |

FOREIGN PATENT DOCUMENTS

| | | | |
|---|---|---|---|
| 0 643 936 A1 | 8/1993 | European Pat. Off. | A47B 21/03 |
| 0 710 456 A2 | 5/1996 | European Pat. Off. | A47B 21/03 |

OTHER PUBLICATIONS

Pp. 12 and 13 from "Quill" (trademark) Ergonomic Products catalog dated spring 1995 that illustrate different commercially available monitor stands.

Pp. 394 and 395 of the Boise Cascade Office Products catalog bearing the copyright "BCOP 1996" that illustrate different commercially available monitor stands.

Pp. 247 of the Office Depot Business Services Devices catalog dated 1996/97 that illustrates different commercially available monitor stands.

Pp. 396 of the S.P.Richards Co catalog bearing the copyright "1996 SPR" that illustrates different commercially available monitor stands.

*Primary Examiner*—Peter M. Cuomo
*Assistant Examiner*—Stephen Vu
*Attorney, Agent, or Firm*—William L. Huebsch

[57] ABSTRACT

A plurality of stand forming members adapted to be assembled in different configurations, including (1) a top member including a top wall that can be adapted to support a monitor and has a peripheral wall projecting away from its bottom surface; (2) a plurality of generally U shaped intermediate members each having an upper surface adapted to either support the peripheral wall of the top member or the lower surface on a different one of the intermediate members; (3) a drawer member for insertion in each of the intermediate members; and (4) a base member adapted to be supported and to support the lower surface of the lowest one of the intermediate members.

17 Claims, 7 Drawing Sheets

STAND FORMING MEMBERS

FIELD OF THE INVENTION

The present invention relates to stand forming members adapted to be assembled in different configurations to form a stand.

DISCLOSURE OF THE INVENTION

The present invention provides a plurality of stand forming members adapted to be assembled in different configurations to either (1) form a stand adapted to support a computer monitor at a selected distance above a horizontal surface, and/or (2) form a storage stand having a plurality of drawers in which items can be stored.

The stand forming members according to the present invention include (1) a top member including a top wall that can be adapted to support a monitor and has a peripheral wall projecting away from its bottom surface; (2) at least one and possibly two, three, or more generally U shaped intermediate members each having opposite upper and lower surfaces with its upper surface adapted to either support the peripheral wall of the top member or the lower surface on a different one of the intermediate members; (3) a drawer member for each of the intermediate members adapted to be in a closed positioned between spaced side parts of that generally U shaped intermediate member with means on those side parts and on the drawer member being provided to affording movement of the drawer member between closed and open positions; and (4) a base member adapted to be supported on a horizontal surface and to support the lower surface of the lowest one of the intermediate members or (if no intermediate member is used) to support the peripheral wall on the top member. The intermediate members and top member each have a predetermined height (e.g., about one and one half inches). Thus, a person can form a stand from those members that is adapted to support a computer monitor at a selected height in multiples of that predetermined height above a horizontal surface by using an appropriate number of, or none of, the intermediate members. Availability of four such intermediate members and a top member each with heights of about one and one half inch will afford assembling such a stand up to seven and one half inches in height and will afford height adjustability in a range of one and one half to seven and one half inches in one and one half inch increments. A height within that range is understood to be appropriate for all male and female persons except for about five percent of the tallest males and about five percent of the shortest females.

When the stand members are to be used to support a computer monitor, preferably the height dimension of the peripheral wall of the top member is about one and one half inches to provide sufficient beam strength for a portion of that peripheral wall that bridges across an open side of the generally U shaped intermediate member supporting it. Also, preferably the top wall of the top member has an array of generally concentric arcuate ribs projecting along its upper surface and defining the portion of its upper support surface on which the monitor is adapted to be supported, and has a plurality of intersecting elongate ribs partially defining the bottom surface of the top member, so that the peripheral wall, the arcuate ribs, and the elongate ribs provide the structural strength for the top wall that is needed to support a computer monitor having a weight of up to 80 pounds.

Also, preferably the means for supporting the drawer members on the intermediate members for movement between their closed and open positions comprises a pair of opposed parallel rails included in each intermediate member, and two spaced tabs projecting outwardly from each of the opposite sides of the drawer member that are slideably supported on upper surfaces of the rails. The intermediate member includes a stop along and projecting above the upper surface of each of the rails, and movement of the drawer member to its open position causes movement of a front pair of those tabs off of the rails and movement of a rear pair of those tabs along the rails into engagement with the stops to define the open position of the drawer member.

BRIEF DESCRIPTION OF DRAWING

The present invention will be further described with reference to the accompanying drawing wherein like reference numerals refer to like parts in the several views, and wherein.

DETAILED DESCRIPTION OF THE DRAWING

Figure 1:
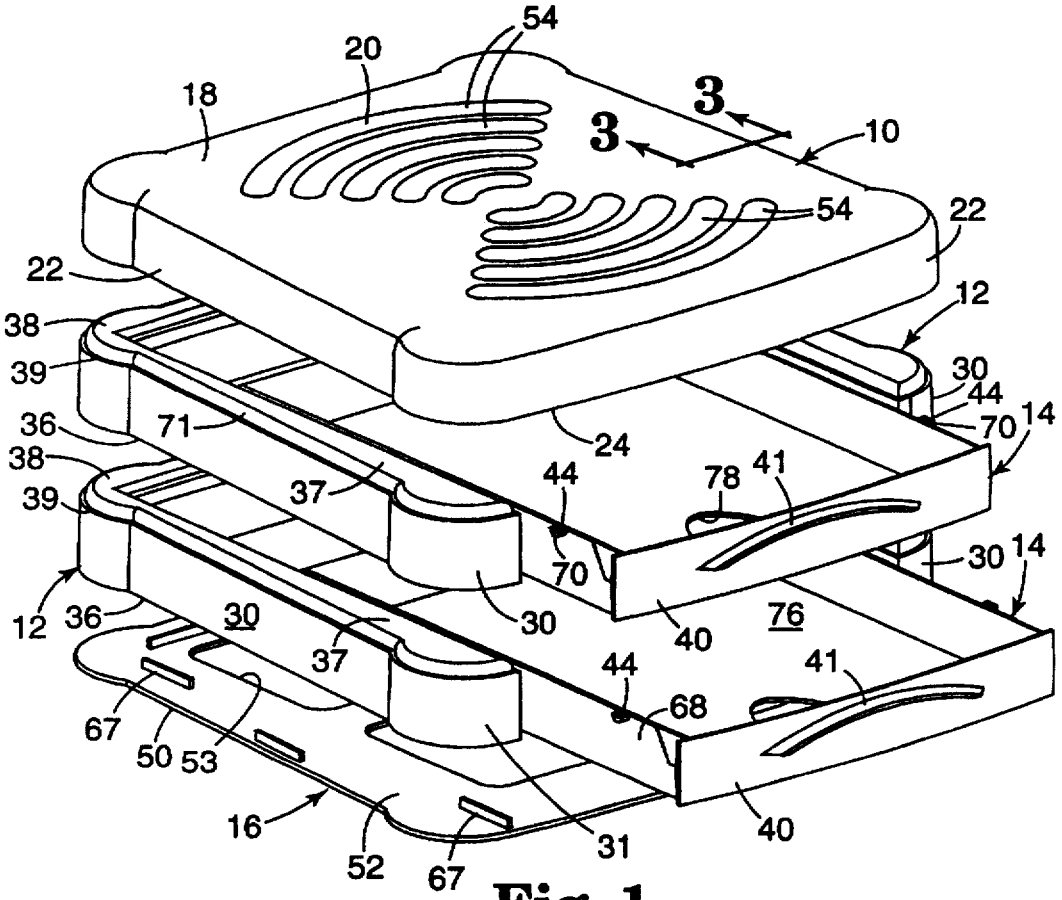
FIG. 1 is a perspective view of a first configuration for a stand adapted for supporting a computer monitor assembled from stand members according to the present invention, which stand is illustrated with certain of those members separated to show detail.
Figure 2:
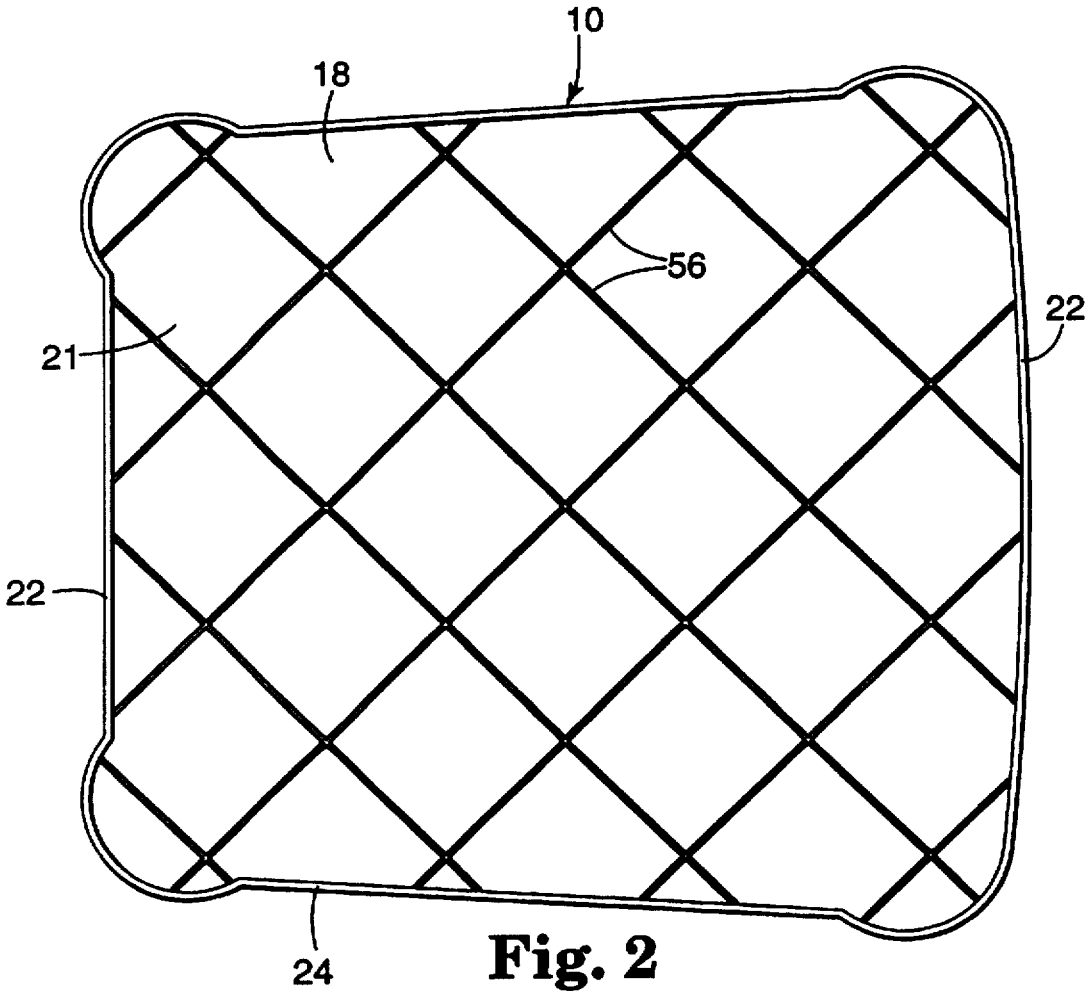
FIG. 2 is an enlarged bottom view of a top member of the stand illustrated in FIG. 1.
Figure 3:
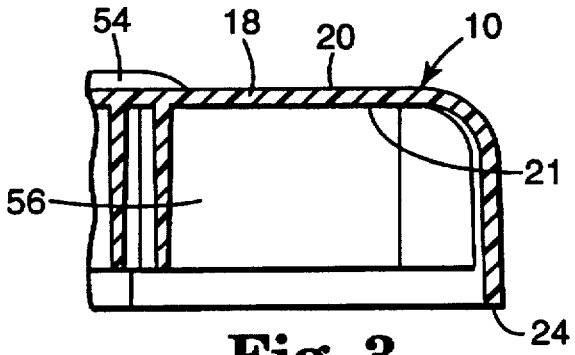
FIG. 3 is an enlarged sectional view taken approximately along line 3—3 of FIG. 1.
Figure 6:
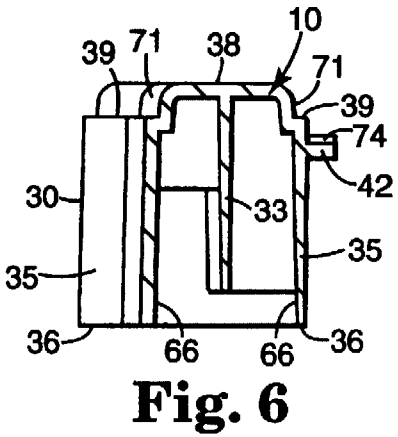
FIG. 6 is an enlarged sectional view taken approximately along line 6—6 of FIG. 4.
Figure 4:
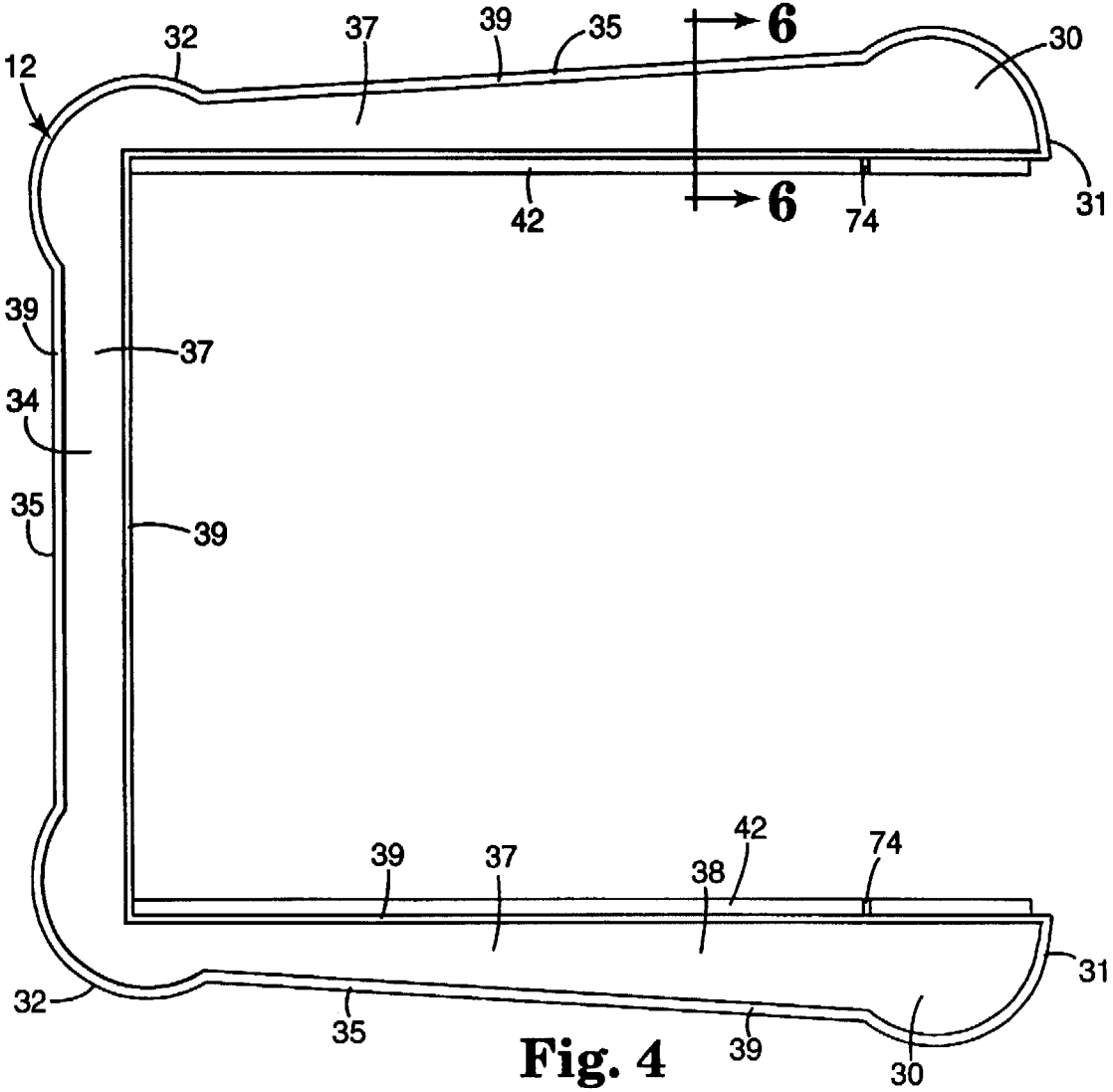
FIG. 4 is an enlarged top view of one of two U shaped intermediate members included in the stand illustrated in FIG. 1.
Figure 5:
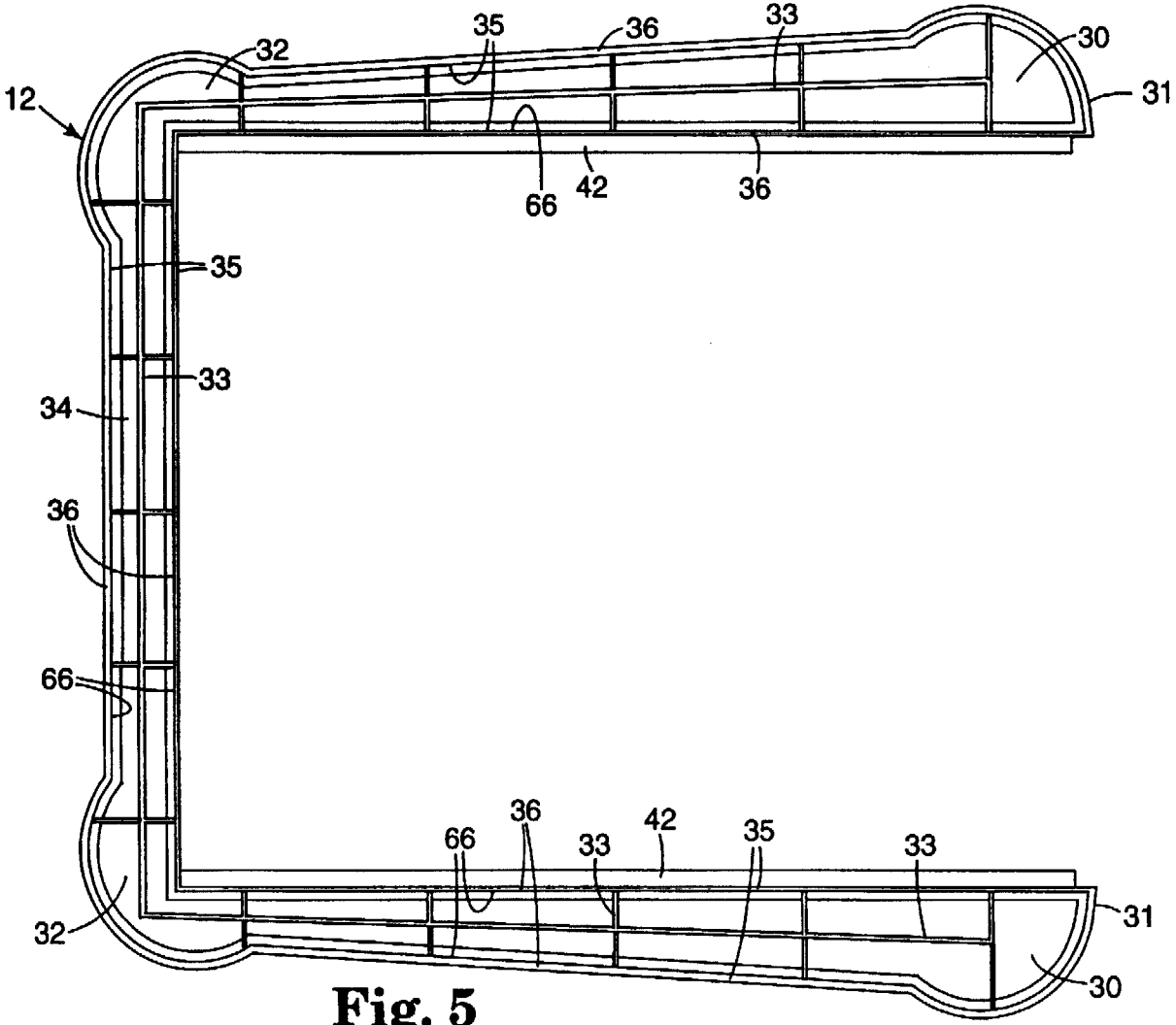
FIG. 5 is an enlarged bottom view of the intermediate member of FIG. 4
Figure 7:
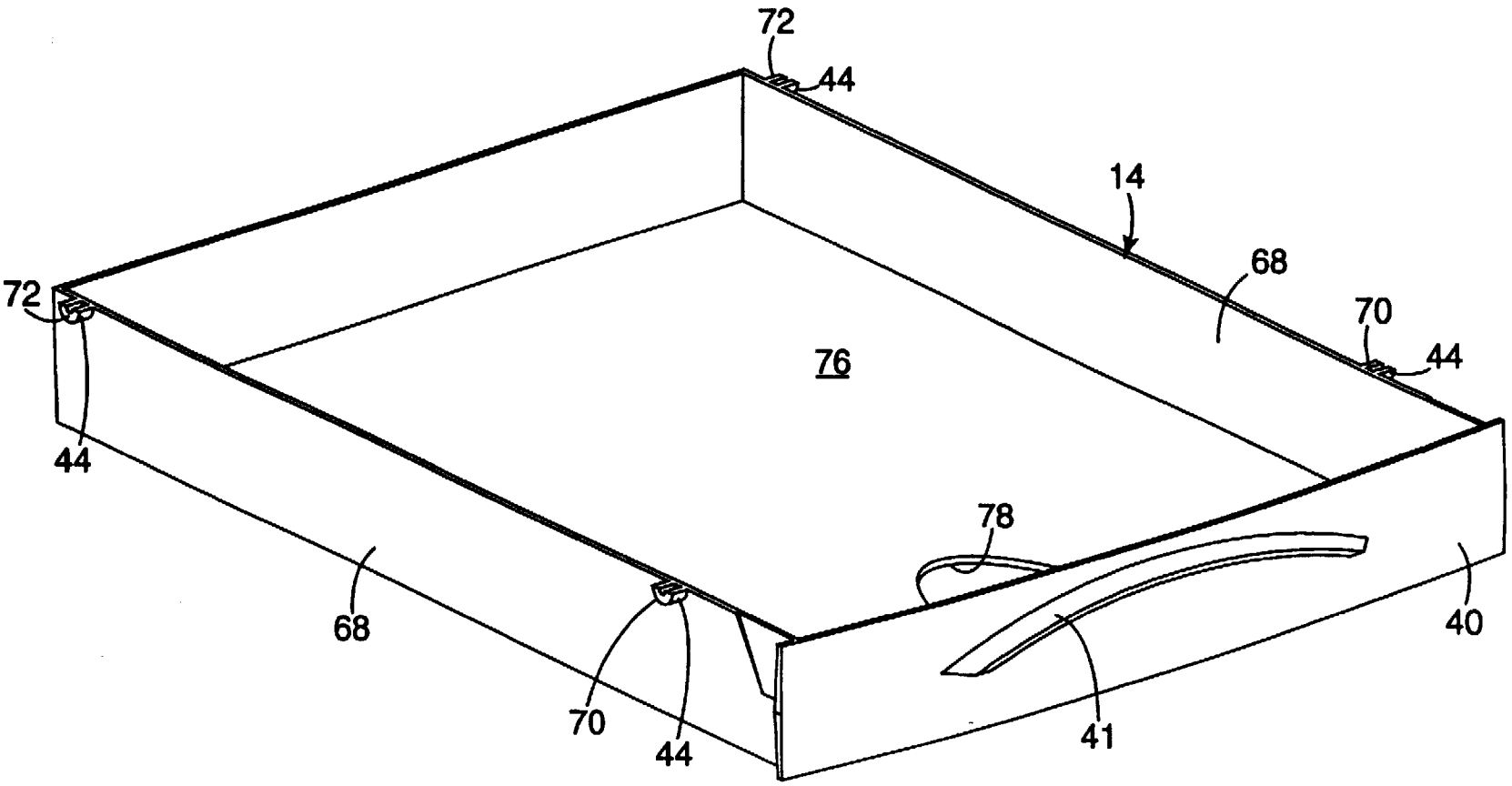
FIG. 7 is an enlarged perspective view of one of two drawer members included in the stand illustrated in FIG. 1.
Figure 8:
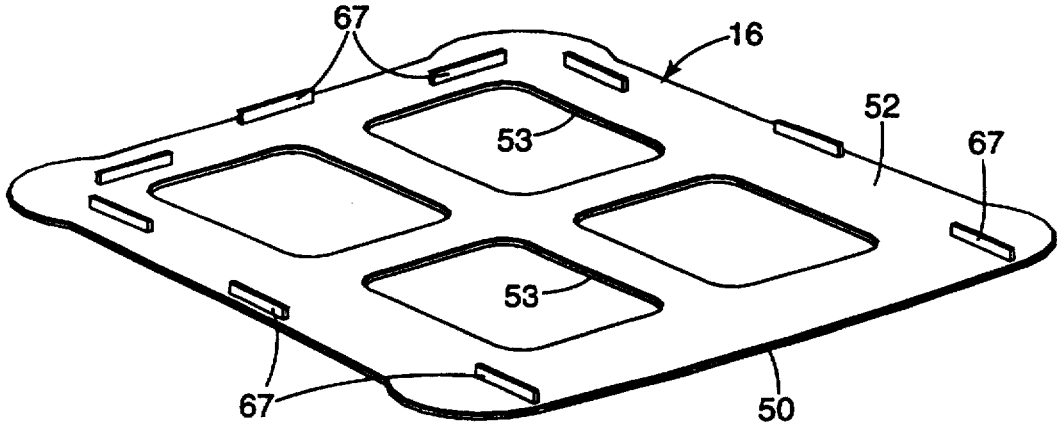
FIG. 8 is an enlarged perspective view of a bottom member included in the stand illustrated in FIG. 1.

Referring now to the drawing there are illustrated a plurality of stand forming members according to the present invention that are molded of polymeric material (e.g., high impact polystyrene). Those stand forming members include a top member 10, U shaped intermediate members 12, drawer members 14, and a base member 16 that are adapted to be assembled in different configurations to form stands adapted to support a computer monitor at different distances above a horizontal surface and/or to form a storage stand having a plurality of the drawer members 14 in which items can be stored. Those configurations include, but are not limited to, the stand illustrated in FIG. 1 that is made of one top member 10, two intermediate members 12, two drawer members 14, and one base member 16; the stand illustrated in FIG. 9 that is made of one top member 10, one intermediate members 12, one drawer member 14, and one base member 16; and the stand illustrated in FIG. 10 that is made of one top member 10, three intermediate members 12, three drawer members 14, and one base member 16.

The top member 10 includes a generally rectangular top wall 18 (e.g., about 13 inches wide by 13½ inches deep) having semi-cylindrical outwardly projecting bosses at its four corners, an upper support surface 20 adapted to support the monitor and an opposite bottom surface 21, and a peripheral wall 22 around the periphery of the top wall 18. The peripheral wall 22 has a top edge joined to the periphery of the top wall 18, projects away from its bottom surface 21 at generally a right angle with respect to its support surface 20, and has a distal edge surface 24 opposite both its top edge and the support surface 20.

The generally U shaped intermediate members 12 (which are U shaped as used when viewed in a plane parallel to the support surface 20 of the top member 10) each have opposite, spaced, elongate, generally parallel, side parts 30 with front and rear ends 31 and 32; and an elongate rear part 34 between the rear ends 32 of those side parts 30. The intermediate member 12 has a top wall having an upper surface 38 that has a planar central portion 37 and a recessed portion 39 around its periphery, and has spaced side walls 35 projecting away from the side of the top wall opposite its upper surface 38 past reinforcing ribs 33 that have distal surfaces defining a lower surface 36 for the intermediate member 12. The recessed portion 39 of the top surface is adapted to support either (1) the distal edge surface 24 on the peripheral wall 22 of the top member 10, or (2) the lower surface 36 of a different one of the intermediate members 12.

The drawer member 14 is between the side parts 30 of the generally U shaped intermediate member 12 in its closed position and has a front panel 40 that, in that closed position, extends between and abuts the front ends 31 of those side parts 30. A projecting curved drawer pull strip 41 on the panel 40 facilitates manual engagement with the drawer member 14. Means including parallel opposed inwardly projecting rails 42 on the side parts 30 of the generally U shaped intermediate member 12 and outwardly projecting tabs 44 from the upper edges of the drawer member 14 are provided for supporting the drawer member 14 on the intermediate member 12 for movement between its closed position, and an open position with the front panel 40 and the majority of the drawer member 14 projecting past the front ends 31 of the side parts 30.

The base member 16 has a bottom supported surface 50 adapted to be supported on a horizontal surface (e.g., a desk top) and an opposite upper surface 52 adapted to support either the lower surface 36 of the lowermost intermediate member 12 or the distal edge surface 24 on the peripheral wall 22 of the top member 10. Four spaced rectangular through openings 53 are formed in the base member 16 to facilitate molding it.

The top member 10 has several structural aspects that afford the strength it needs to support a computer monitor, including 21 inch monitors that have weights of about 80 pounds. The height dimension of the peripheral wall 22 on the top member 10 is about one and one half inches to provide (despite being relatively thin, e.g., 0.110 inch) sufficient beam strength to restrict deflection under the weight of a monitor of a portion of that peripheral wall 22 that bridges across the open side of the U shaped intermediate member 12 that supports it. Also, the top wall 18 of the top member 10 has two arrays of generally concentric arcuate ribs 54 with semi-circular cross sections projecting upwardly along its upper surface and defining the portion of its upper Support surface 20 on which the monitor is adapted to be supported. The top wall 18 also has a plurality of intersecting elongate ribs 56 (e.g., 0.08 inch thick and 0.6 inch high) partially defining its bottom surface 20, which ribs 56 intersect at various locations including between the arrays of the arcuate ribs 54 to add strength to that planar portion of the top wall 18.

The top, intermediate and bottom members 10, 12, and 16 are adapted to engage each other in ways that will insure causing and retaining proper vertical alignment with each other, including insuring that the side parts 30 of the intermediate members 12 are properly spaced to receive the drawer member 14 therebetween. The side walls 35 of the intermediate member 12 have opposed inner surfaces 66 adjacent its lower surface 36. The base member 16 includes elongate lugs 67 projecting above its upper surface 52 that are adapted to be positioned along both of the opposite inner surfaces 66 along both of the side parts 30 and along the rear part 34 of the intermediate member 12 to accurately locate those parts 30 and 34 along the upper surface 52 of the base member 16. Also, the elongate side parts 30 and rear part 34 have vertical surfaces 71 between the recessed surface portion 39 and the central surface portion of the top surface 38 for the intermediate member 12. Those vertical surface 71 are adapted to be closely positioned either (1 ) along the inner surface of the peripheral wall 22 on the top member 10 or (2) along the opposite inner surfaces 66 of the side walls 35 of the side and rear parts 30 and 34 of another intermediate member 12.

Figure 9:
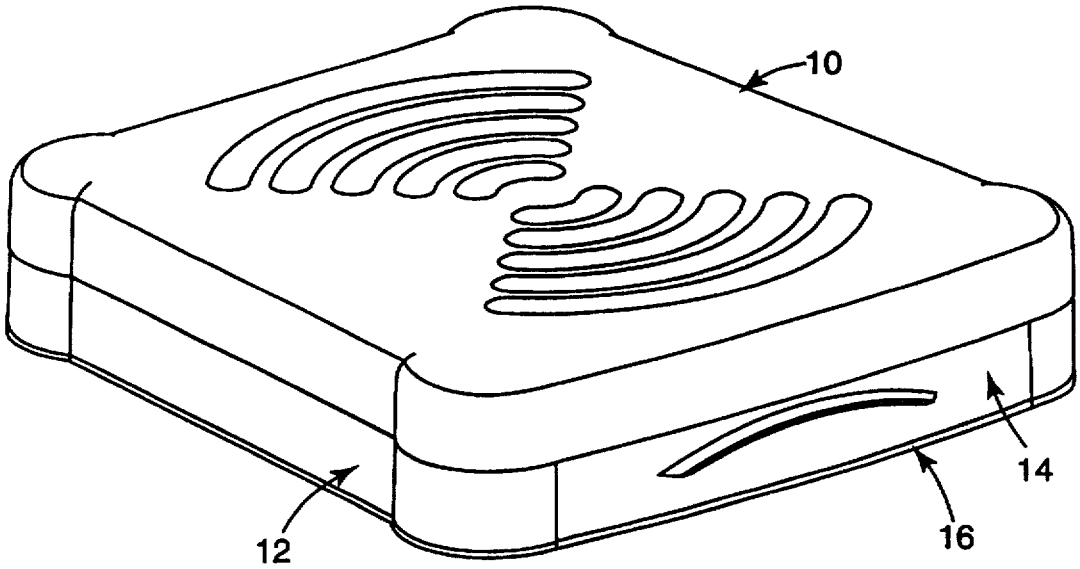
FIG. 9 is a perspective view of a second configuration for a stand adapted for supporting a computer monitor assembled from stand members according to the present invention.
Figure 10:
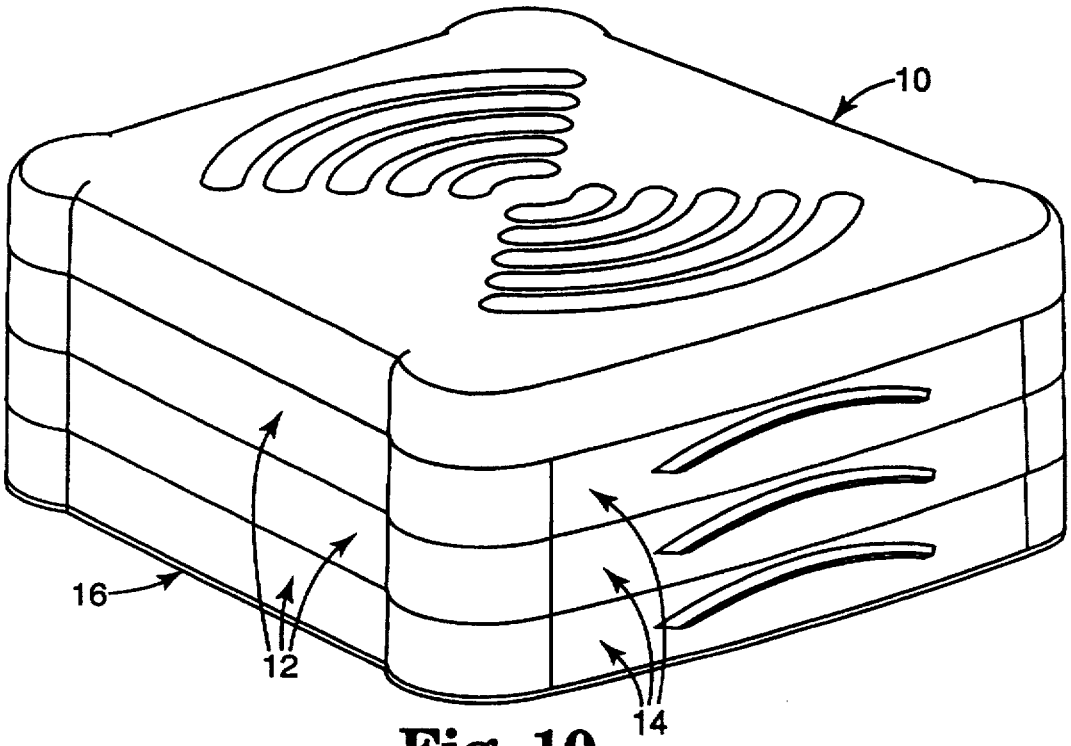
FIG. 10 is a perspective view of a third configuration for a stand adapted for supporting a computer monitor assembled from stand members according to the present invention.

Stands can be assembled using different numbers of the intermediate members 12, such as one of the intermediate members 12 as is illustrated in FIG. 9, two of the intermediate members 12 as is illustrated in FIG. 1, or three of the intermediate members 12 as is illustrated in FIG. 10. More of the intermediate members 12 could be used, or none could be used so that the top member 10 was supported directly on the base member 16. As an example, the intermediate members 12 can each have height dimensions between their upper and lower surfaces 38 and 36 of about one and one half inches, and the height dimension of the top member 10 between its upper surface 20 and its distal edge surface 24 can also be about one and one half inches so that those members 10 and 12 can be used to assemble a stand having different heights between the supported surface 50 of the base member 16 and the upper surface 20 of the top member 10 in one and one half inch increments.

The drawer member 14 has opposite side walls 68 positioned along the side parts 30 of the intermediate member 12 in the closed position of the drawer member 14. The means for supporting the drawer member 14 on the intermediate member 12 for movement between its closed and open positions comprises the pair of opposed parallel rails 42 included in the intermediate member 12 and projecting toward each other from its side parts 30 close to the recessed portions 39 of the upper surface 38, which rails 42 have upper surfaces adjacent the upper surface 38, and the two spaced tabs 44 projecting outwardly from the top edge of each of the opposite side walls 68 of the drawer member 16 that are slidably supported on the upper surfaces of the rails 42. Each pair of tabs 44 includes a front tab 70 adjacent the front panel 40 and a rear tab 72 adjacent the opposite end of the drawer member 14. The intermediate member 12 includes a stop 74 along and projecting above the upper surface of each of the rails 42 adjacent the front end 31 of the side part 30 from which the rail 42 projects. Movement of the drawer member 14 to its open position causes movement of the two front tabs 70 off of the rails 42 and movement of the two rear tabs 72 along the rails 42 into engagement with the stops 74 to define the open position of the drawer member 14. The side walls 68 of the drawer member 14 are slightly less in height than the height of the intermediate member 12 between its recessed top surface portion 39 and its lower surface 36 to afford its movement therebetween. The drawer member 14 has a horizontal bottom wall 76 of a size that will allow either eight and one half by eleven inch paper or A10 size paper to lie flat on it. The bottom wall 76 has a through opening 78 adjacent the front panel 40 to afford lifting objects (e.g., paper sheets) of off the bottom wall 76 by inserting a persons finger through the opening 78 when the drawer member 14 is in its open position. Alternatively, removable dividers (not illustrated) could be provided for use in the drawer member 14.

The present invention has now been described with reference to one embodiment of each of the stand forming members described. It will be apparent to those skilled in the art that many changes can be made in those embodiments without departing from the scope of the present invention. Thus, the scope of the present invention should not be limited to the structures described in this application, but only by the structures described by the language of the claims and the equivalents thereof.

What is claimed is:

1. A plurality of stand forming members adapted to be assembled in different configurations to form a stand adapted to support a computer monitor at different distances above a horizontal surface, said members comprising:

a top member including a top wall having a periphery, an upper support surface adapted to support the monitor and an opposite bottom surface, and a continuous peripheral wall around the entire periphery of said top member, said peripheral wall having a top edge joined to the periphery of said top wall, projecting away from said bottom surface at generally a right angle with respect to said support surface, and having a distal edge surface opposite said top edge and said support surface;

at least one intermediate member having opposite, spaced, elongate, generally parallel, side parts with front and rear ends, and an elongate rear part between the rear ends of said side parts, said rear and side parts providing a lower surface for said intermediate member and said intermediate member having an upper surface opposite said lower surfaces adapted to support the distal edge surface on the peripheral wall of said top member and being generally U shaped along said upper and lower surfaces of said intermediate member;

a drawer member having a front panel adapted to be positioned between said side parts of said generally U shaped intermediate member with said panel extending between the front ends of said side parts;

means on said intermediate member and on said drawer member for supporting said drawer member on said intermediate member for movement between a closed position with the drawer member between said side parts and said panel extending between the front ends of said side parts, and an open position with the majority of said drawer member projecting past the front ends of said side parts; and a base member having a bottom supported surface adapted to be supported on the horizontal surface and an opposite upper surface adapted to support the lower surface of said intermediate member or the distal edge surface of the peripheral wall of said top member.

2. A plurality of stand forming members according to claim 1 including a plurality of said intermediate members and one of said drawer members for each one of said intermediate members, the upper surfaces of said intermediate members each being adapted to support the distal edge surface of said top member or the lower surfaces of another one of said intermediate members, and the lower surfaces of each of said intermediate members being adapted to be supported on either the top surface of said bottom member or on the upper surfaces of another one of said intermediate members.

3. The plurality of stand forming members according to claim 1 wherein said top wall of the top member has an array of generally concentric arcuate ribs projecting along said upper surface and defining the portion of said upper support surface on which the monitor is adapted to be supported, and has a plurality of intersecting elongate ribs partially defining said bottom surface of the top member, said peripheral wall, said arcuate ribs and said elongate ribs providing structural strength for said top member.

4. The plurality of stand forming members according to claim I wherein said drawer member has opposite side walls positioned along said side parts of said intermediate member in the closed position of said drawer member, and said means for supporting said drawer member on said intermediate member for movement between said closed and open positions comprises a pair of opposed parallel rails included in said intermediate member and projecting toward each other from said side parts, said rails having upper surfaces adjacent said upper surfaces of said side parts, and two spaced tabs projecting outwardly from each of said opposite side walls of said drawer member, said tabs being slidably supported on said upper surfaces of said rails.

5. The plurality of stand forming members according to claim 4 wherein said spaced tabs on each side of said drawer member includes a front tab adjacent said front panel and a rear tab adjacent an end of said side opposite said front panel with said tabs being along an upper edge of said side walls, and said intermediate member includes a stop along and projecting above the upper surface of each of said rails adjacent the front end of said side part from which the rail projects, with movement of said drawer member to said open position causing movement of said front tabs off of said rails and movement of said rear tabs along said rails into engagement with said stops to define said open position of the drawer member.

6. The plurality of stand forming members according to claim I wherein said drawer member includes a horizontal bottom wall, and said bottom wall has a through opening adjacent said front panel to afford lifting objects off of said bottom wall by inserting a persons finger through said through opening when said drawer member is in said open position.

7. The plurality of stand forming members according to claim 2 wherein each of said intermediate members has a top wall having opposite longitudinally extending edges along each of said side and rear parts and defining said upper surface of said intermediate member, and has side walls having opposed inner surfaces along said longitudinally extending edges of said top wall and projecting at generally a right angle with respect to said upper surface of said intermediate member and away from the side of said top wall opposite said upper surface; and said base member includes lugs projection above said upper surface of said base member adapted to be positioned along both of the opposite inner surfaces of said side walls along both of said side parts and said rear part to accurately locate said intermediate member along the upper surface of said base member.

8. The plurality of stand forming members according to claim 7 wherein said elongate side parts and elongate rear part each have two surfaces disposed generally at right angles to each around the periphery of said intermediate member, one of said two surfaces defining a recessed portion of said top surface of said intermediate member recessed from a central portion of said top surface, and the other of said two surfaces extending between said recessed and central portions of said top surface and being adapted to be closely positioned along the opposite inner surfaces of said side walls of another one of said intermediate portions.

9. The plurality of stand forming members according to claim 1 wherein height dimension of said peripheral wall of said top member between said top surface and distal edge surface is about one and one half inches.

10. The plurality of stand forming members according to claim 1 wherein said intermediate members each have a height dimension between said upper surface and said lower surface of about one and one half inches, and the height dimension of said peripheral wall of said top member between said top surface and distal edge surface is about one and one half inches, and said distal edge surface of said top member is adapted to be supported on the upper surface of said base member so that said stand can be assembled to provide different heights between said bottom surface of said base member and the upper surface of said top member in about one and one half inch increments.

11. The plurality of stand forming members according to claim 9 including two of said intermediate members and two of said drawer members.

12. The plurality of stand forming members according to claim 9 including three of said intermediate members and three of said drawer members.

13. A plurality of stand forming members adapted to be assembled in different configurations to form a storage stand, said members comprising:

a top member including a top wall having a periphery, an upper surface, and an opposite bottom surface, and a peripheral wall around the periphery of said top member, having a top edge joined to the periphery of said top wall, projecting away from said bottom surface at generally a right angle with respect to said upper surface, and having a distal edge surface opposite said top edge and said upper surface;

a plurality of intermediate members each having opposite, spaced, elongate, generally parallel, side parts with front and rear ends, and an elongate rear part between the rear ends of said side parts, said intermediate member having a lower surface, having an upper surface opposite said lower surfaces adapted to support the distal edge surface on the peripheral wall of said top member, and being generally U shaped along said upper and lower surfaces of said intermediate member;

a drawer member for each of said intermediate members adapted to be positioned between said side parts of said intermediate member and having a front panel adapted to extend between the front ends of said side parts;

means on said intermediate members and on said drawer members for supporting said drawer member on said intermediate member for movement between a closed position with the drawer member between said side parts and said panel extending between the front ends of said side parts, and an open position with the majority of said drawer member projecting past the front ends of said side parts; and a base member having a bottom supported surface adapted to be supported on the horizontal surface and an opposite upper surface adapted to support the lower surface of said intermediate member or the distal edge surface of the peripheral wall of said top member;

the upper surfaces of said intermediate members each being adapted to support the distal edge surface of said top member or the lower surfaces of another one of said intermediate members, and the lower surfaces of each of said intermediate members being adapted to be supported on either the top surface of said bottom member or on the upper surfaces of another one of said intermediate members; and each of said drawer members including a horizontal bottom wall, and said bottom wall having a through opening adjacent said front panel to afford lifting objects off of said bottom wall by inserting a persons finger through said through opening when said drawer member is in said open position.

14. The plurality of stand forming members according to claim 13 wherein each of said drawers members has opposite side walls adapted to be positioned along said side parts of one of said intermediate member in the closed position of the drawer member, and said means for supporting said drawer member on said intermediate member for movement between said closed and open positions comprises a pair of opposed parallel rails included in said intermediate member and projecting toward each other from said side walls, said rails having upper surfaces adjacent said upper surface of said intermediate member, and two spaced tabs projecting outwardly from each of said opposite sides of said drawer member, said tabs being slidably supported on said upper surfaces of said rails.

15. A plurality of stand forming members adapted to be assembled in different configurations to form a storage stand, said members comprising:

a top member including a top wall having a periphery, an upper surface, and an opposite bottom surface, and a peripheral wall around the periphery of said top member, said peripheral wall having a top edge joined to the periphery of said top wall, projecting away from said bottom surface at generally a right angle with respect to said upper surface, and having a distal edge surface opposite said top edge and said upper surface;

a plurality of generally U shaped intermediate members each having opposite, spaced, elongate, generally parallel, side parts with front and rear ends, and an elongate rear part between the rear ends of said side parts, said intermediate member having a lower surface having an upper surface opposite said lower surfaces adapted to support the distal edge surface on the peripheral wall of said top member;

a drawer member for each of said intermediate members adapted to be positioned between said side parts of said intermediate member and having a front panel adapted to extend between the front ends of said side parts;

means on said intermediate members and on said drawer members for supporting said drawer member on said intermediate member for movement between a closed position with the drawer member between said side parts and said panel extending between the front ends of said side parts, and an open position with the majority of said drawer member projecting past the front ends of said side parts; and a base member having a bottom supported surface adapted to be supported on the horizontal surface and an opposite upper surface adapted to support the lower surface of said intermediate member or the distal edge surface of the peripheral wall of said top member;

the upper surfaces of said intermediate members each being adapted to support the distal edge surface of said top member or the lower surfaces of another one of said intermediate members, and the lower surfaces of each of said intermediate members being adapted to be supported on either the top surface of said bottom member or on the upper surfaces of another one of said intermediate members;

each of said drawer members having opposite side walls adapted to be positioned along said side parts of one of said intermediate members in the closed position of the drawer member;

said means for supporting said drawer member on said intermediate member for movement between said closed and open positions comprising a pair of opposed parallel rails included in said intermediate member and projecting toward each other from said side walls, said rails having upper surfaces adjacent said upper surface of said intermediate member, and two spaced tabs projecting outwardly from each of said opposite sides of said drawer member, said tabs being slidably supported on said upper surfaces of said rails, said spaced tabs on each side of each of said drawer members including a front tab adjacent said front panel and a rear tab adjacent an end of said side opposite said front panel with said tabs being along an upper edge of said drawer member, and said intermediate member including a stop along and projecting above the upper surface of each of said rails adjacent the front end of said side part from which the rail projects, with movement of said drawer member to said open position causing movement of said front tabs off of said rails and movement of said rear tabs along said rails into engagement with said stops to define said open position of the drawer member.

16. A plurality of stand forming members adapted to be assembled in different configurations to form a storage stand, said members comprising:

a top member including a top wall having a periphery, an upper surface, and an opposite bottom surface, and a peripheral wall around the periphery of said top member, said peripheral wall having a top edge joined to the periphery of said top wall, projecting away from said bottom surface at generally a right angle with respect to said upper surface, and having a distal edge surface opposite said top edge and said upper surface;

a plurality of generally U shaped intermediate members each having opposite, spaced, elongate, generally parallel, side parts with front and rear ends, and an elongate rear part between the rear ends of said side parts, said intermediate member having a lower surface having an upper surface opposite said lower surfaces adapted to support the distal edge surface on the peripheral wall of said top member;

a drawer member for each of said intermediate members adapted to be positioned between said side parts of said intermediate member and having a front panel adapted to extend between the front ends of said side parts;

means on said intermediate members and on said drawer members for supporting said drawer member on said intermediate member for movement between a closed position with the drawer member between said side parts and said panel extending between the front ends of said side parts, and an open position with the majority of said drawer member projecting past the front ends of said side parts; and a base member having a bottom supported surface adapted to be supported on the horizontal surface and an opposite upper surface adapted to support the lower surface of said intermediate member or the distal edge surface of the peripheral wall of said top member;

the upper surfaces of said intermediate members each being adapted to support the distal edge surface of said top member or the lower surfaces of another one of said intermediate members, and the lower surfaces of each of said intermediate members being adapted to be supported on either the top surface of said bottom member or on the upper surfaces of another one of said intermediate members;

each of said intermediate members having a top wall having opposite longitudinally extending edges along each of said side and rear parts and defining said upper surface of said intermediate member, and having side walls having opposed inner surfaces along the longitudinally extending edges of said top wall and projecting at generally a right angle with respect to said upper surface of said intermediate member and away from the side of said top wall opposite said upper surface; and said base member including members projection above said upper surface of said base member adapted to be positioned along both of the opposite inner surfaces of said side walls along both of said side parts and said rear part to accurately locate said intermediate member along the upper surface of said base member.

17. The plurality of stand forming members according to claim 16 wherein said elongate side parts and elongate rear part of each of said intermediate members each have two surfaces disposed generally at right angles to each other around the periphery of said intermediate member, one of said two surfaces defining a second portion of said top surface of said intermediate member recessed from a central portion of said top surface, and the other of said two surfaces extending between said central and recessed portions of said top surface and being adapted to be closely positioned along the opposite inner surfaces of said side walls of another one of said intermediate portions.

* * * * *